United States Patent [19]

Föhl

[11] 4,388,985

[45] Jun. 21, 1983

[54] BRAKING-AND/OR BLOCKING DEVICE FOR LOAD CARRYING FLEXIBLE PULLING MEANS, FOR EXAMPLE, BELTS OR ROPES

[75] Inventor: Artur Föhl, Schorndorf, Fed. Rep. of Germany

[73] Assignee: REPA Feinstanzwerk GmbH, Alfdorf, Fed. Rep. of Germany

[21] Appl. No.: 214,759

[22] Filed: Dec. 9, 1980

[30] Foreign Application Priority Data

Dec. 14, 1979 [DE] Fed. Rep. of Germany ..... 2950470

[51] Int. Cl.[3] ..... B65H 59/14

[52] U.S. Cl. ..... 188/65.4

[58] Field of Search ..... 188/65.1–65.4, 188/188, 189; 242/107.2; 182/5

[56] References Cited

U.S. PATENT DOCUMENTS

| | | | |
|---|---|---|---|
| 278,171 | 5/1883 | Oldroyd | 188/65.3 |
| 311,039 | 1/1885 | Scheidt et al. | 188/65.4 X |
| 461,528 | 10/1891 | Fowler | 188/65.3 |
| 2,970,357 | 2/1961 | Pinson et al. | 188/65.1 X |
| 4,171,795 | 10/1979 | Bianchi | 188/188 X |

*Primary Examiner*—Duane A. Reger

*Attorney, Agent, or Firm*—Herbert L. Lerner; Laurence A. Greenberg

[57] ABSTRACT

Device for braking and/or blocking of load carrying flexible pulling means such as belts or ropes having a braking roller partly wrapped by the load carrying flexible pulling means. The roller can move with respect to a clamping surface when the pulling means exerts a tangential force on the braking roller. A clamping surface is disposed adjacent the pulling means near the braking roller. Braking roller movement effects clamping of the pulling means against the clamping surface.

10 Claims, 9 Drawing Figures

BRAKING-AND/OR BLOCKING DEVICE FOR LOAD CARRYING FLEXIBLE PULLING MEANS, FOR EXAMPLE, BELTS OR ROPES

BACKGROUND OF THE INVENTION

1. Field of the Invention

The invention relates to a braking-and/or blocking device for load carrying, flexible pulling means, for example, belts or ropes, which device can be activated by a load on the pulling means, and which causes the braking of the pulling means by friction-or form-fitting clamping.

2. Description of the Prior Art

There are known devices comprising braking mechanisms for pulling means, for example, a safety belt, wherein, at activation of the braking mechanism, the belt is securely mechanically clamped between suitably formed clamping jaws, and thus a further pulling-out of the belt is prevented. At this clamping process, the belt fabric is locally very strongly squeezed, and damaged thereby, so that after extended use, or at the occurrence of extreme forces, frequently the damaged belt can not withstand the load. On the other hand, there are also known restraining systems with braking devices for safety belts, wherein the belt is partly wrapped around several braking rollers, so that when activated, i.e. when the belt is under heavy load, the belt band is braked by the static friction between the belt surface and the roller surface. Hereby, in order to block the belt without slippage, a great number of sequentially arranged braking rollers is required.

SUMMARY OF THE INVENTION

An object of the invention is to provide a braking-and/or blocking device of the above-mentioned type in such manner that in a simple, space-limited construction form a reliable braking and the reliable blocking of the pulling means is assured, without risk of damage to the flexible pulling means.

With the foregoing and other objects in view, there is provided in accordance with the invention a device for braking or blocking of load carrying flexible pulling means, such as belts or ropes, comprising a braking roller partly wrapped by the load carrying flexible pulling means and which can move with respect to a clamping surface when said pulling means exerts a tangential force on the braking roller, a member with said clamping surface disposed adjacent the pulling means near the braking roller, said braking roller movement effecting clamping of the pulling means against said clamping surface.

Other features which are considered as characteristic for the invention are set forth in the appended claims.

Although the invention is illustrated and described herein as embodied in a braking-and/or blocking device for load carrying flexible pulling means, for example, belts or ropes, it is nevertheless not intended to be limited to the details shown, since various modification may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings in which.

DETAILED DESCRIPTION OF THE INVENTION

Figure 1:
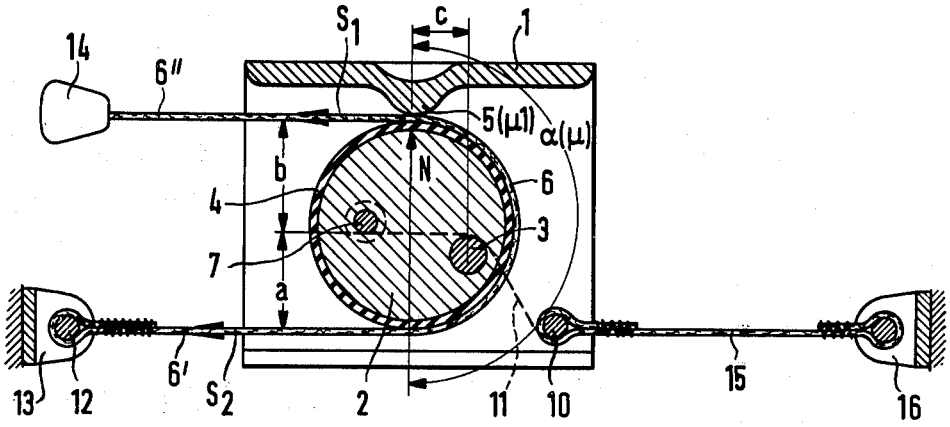
FIG. 1 illustrates a first embodiment of the braking and/or blocking device according to the invention in a sectional view, and in particular shows the relationship of the braking roller, clamping surface, pulling means, load and counter support.

In accordance with the invention a braking roller around which the pulling means is partly wrapped, is movable relative to a clamping surface by the tangential force of the pulling means on the braking roller when activated, and effects a friction-and/or formfitting clamping of the pulling means, directly or indirectly, in such a manner that the clamping force increases, preferably linearly, with increasing pulling load. Hereby, it is advantageous if the braking friction between the rolling surface of the arrested braking roller and the pulling means is such that a force moment is acting between the braking roller and the clamping surface which is sufficient to clamp the pulling means without slippage.

By the combined action of braking friction according to the $e^{\mu\alpha}$-effect and the clamping action, the flexible pulling means are gently used, and the clamping force generated by the tangential force of the braking roller is dependent on the actual load on the pulling means, whereby by increasing load the clamping force also increases. The invention can successfully be applied to all pull- and lifting devices for loads and for people.

According to an advantageous embodiment of the invention, arresting means are provided against which, in case of activation, i.e. at the presence of a predetermined pull-force, the braking roller which is free-wheeling when not activated, can be moved, and arrested, preferably by locking teeth, and said arresting means itself can be moved relative to a stationary clamping surface and a portion of the pulling means disposed before this clamping surface, against a spring force into a position where the pulling means is clamped. Thereby, the braking roller is arrested at the arresting element when a certain pull-force occurs, whereupon the braking moment acting on the braking roller presses the arresting element against the clamping surface, and thereby determines the clamping force. Such a device is especially applicable for braking free fall, as a safety device to protect persons and loads, for example, as a brake for rolling doors, rolling shutters, solaria and the like.

In a further advantageous embodiment of the invention, the braking roller can swing in a housing, or carrier, eccentrically and in relation to a clamping surface of said housing through a path determined by a swing stop, up to its contact with the clamping surface. Here also the pulling force determines the force moment by which the braking roller is pressed against the clamping surface and thereby against the pulling means. This embodiment is especially advantageous for use in clamping devices for lashing- and anchoring ropes or belts, or as rope- or belt shortening devices, for example, safety lines for construction workers.

Also, an advantageous embodiment of the invention results if the braking roller is eccentrically supported in a housing and is pressed against a clamping roller by the force of a spring. The pulling means which is fastened to a (load) counter support at one side, partly wraps around the braking- and clamping roller.

A two-armed lever, which is hingeably supported at the housing, carries at one arm the load, and at the other lever arm a clamping pad which can press against the pulling means and the clamping roller by the force moment generated by the load. A device of this type is especially applicable as a rope-down device for people, and also for loads, whereby in the first-mentioned case the person who is roped down can regulate the stop position or running position of the device by a hand-lever which influences the spring tension. According to another advantageous development for this purpose a hand lever is provided which is hingeably supported at the housing, form-fittingly and eccentrically coupled to the braking roller, and which presses the braking roller against the clamping roller by spring force, whereby the braking roller can be raised (lifted) from the clamping roller by moving the hand lever against the spring force.

Further advantageous details of the invention will be shown and explained with the aid of the typical embodiments represented in the drawings.

Figure 2:
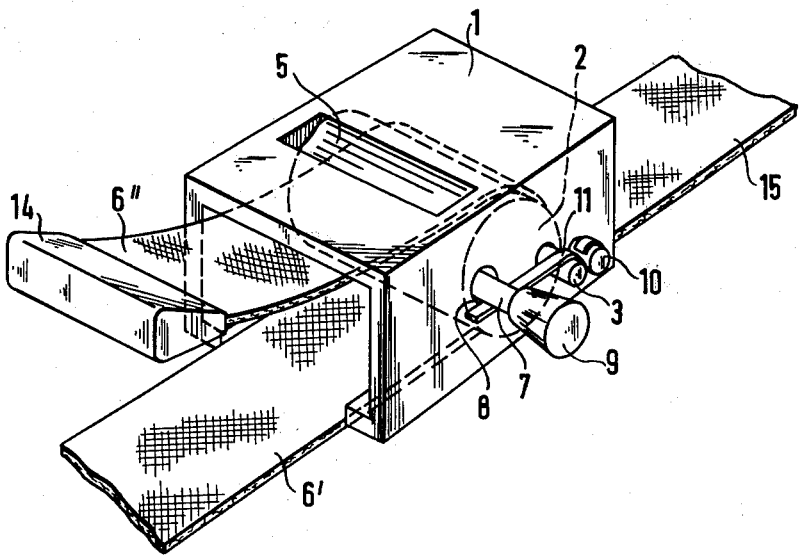
FIG. 2 shows the device according to FIG. 1 in a perspective representation.

In the embodiment according to FIGS. 1 and 2, a roller-shaped braking roller 2 is eccentrically and hingeably supported on a rotation shaft 3 in a U-shaped housing 1. The surface of the roller is provided with a rubber mantle 4. The housing 1 is provided with a clamping surface 5 which is stamped into the housing wall like a bead. A flexible pulling means 6 in the form of a flexible band wraps around the braking roller 2 corresponding to the angle $\alpha$. Approximately diametrically opposite the shaft 3 which at both sides is supported in the housing walls, there is a pin-like swing stop 7 supported in the braking roller 2. The swing stop 7 is guided in a slot 8 of the housing wall so that it can slide, which limits the swing motion of the braking roller 2 at both sides. A handle 9 is fastened to the pin-like swing stop 7 outside of the housing 1. The braking roller 2 is pressed with a predetermined pre-tension against the clamping surface 5 by a form-spring 11 which is supported at fastening point 10. The pulling means 6 is provided at the pulling means portion 6' with an anchor position 12 for securing a load 13, while the other pulling means portion 6'' is disposed between the braking roller 2 and the clamping surface 5, and has at its free end a pull-handle 14. Finally, another pulling means 15, also in form of a belt is at one side fastened to the fastening pin 10 which is fixed to the housing, and at the other side secured to a counter support 16. Obviously, the device can be fastened at point 13 to a counter support, and the load placed at point 16. Now, if the pulling means 6 is pulled at the handle 14, the whole system is tensioned. The force of the spring 11 is easily overcome until all of the pulling means are freely pulled out of the system. When the load is removed from the pulling means 6 at the handle 14, the spring force of the form spring 11 becomes immediately effective, and clamps the pulling means 6 securely between the clamping surface 5 and the surface of the braking roller. When a further pulling load is applied between the anchor points 13 and 16, a clamping force is developed at the clamping surface 5 by the lever force and the band braking effect which is so great that it prevents the pulling means 6 from slipping through. The handle 9 at the swing stop 7 serves for resetting the system. By pressing the handle 9 down, the clamping point becomes free, so that the pulling means 6 can be brought back into the starting position. During the tensioning operation, the braking roller 2 is turned counter-clockwise by the friction force at the surface of the braking roller, whereby the clamping point is freed for clamping or release.

Figure 5:
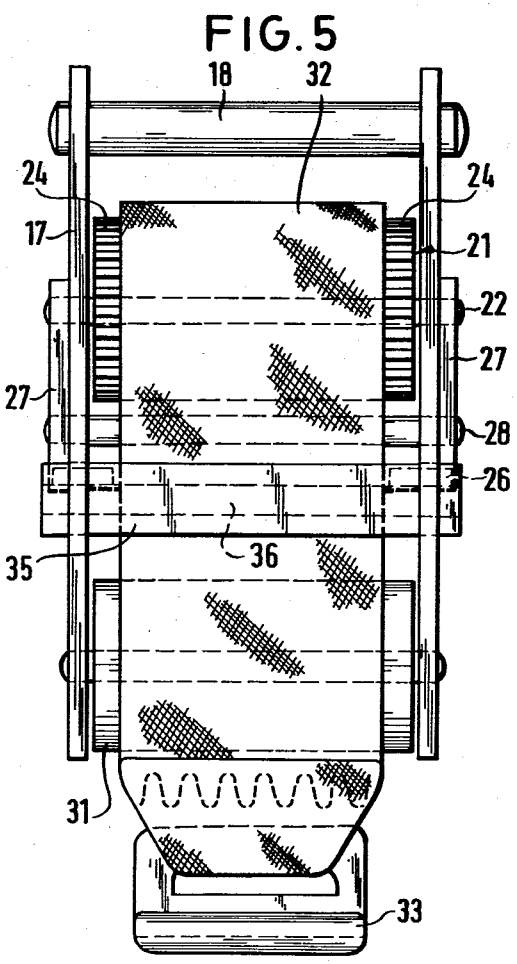
FIGS. 3–5 illustrate a second embodiment of the device according to the invention, shown in a plan view, and in two operational positions, shown as sectional view.
Figure 4:
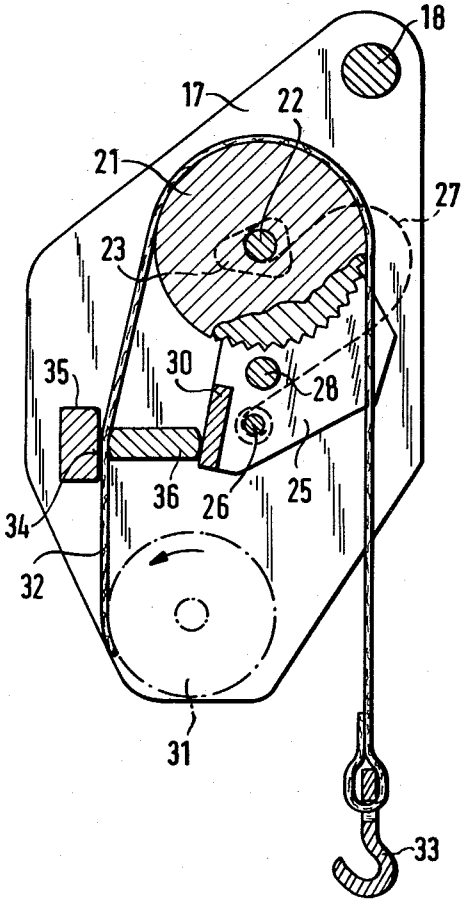
Figure 3:
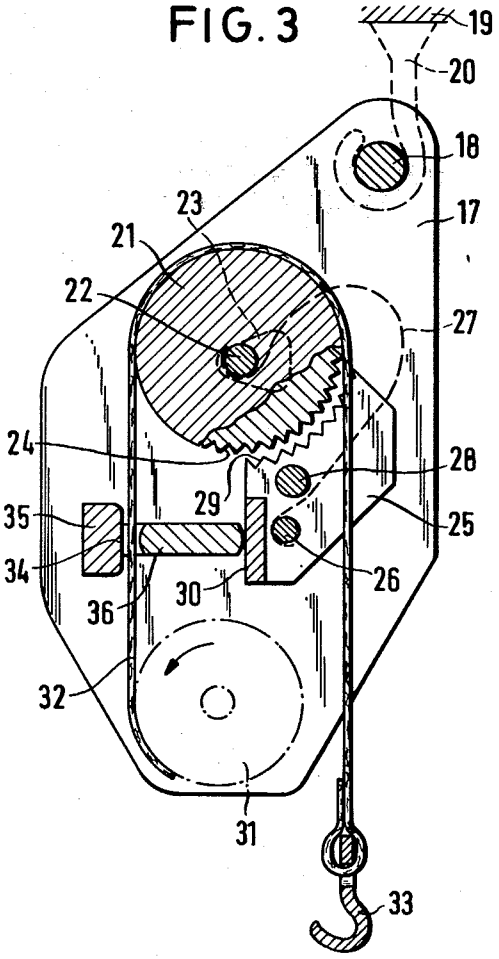
Figure 6:
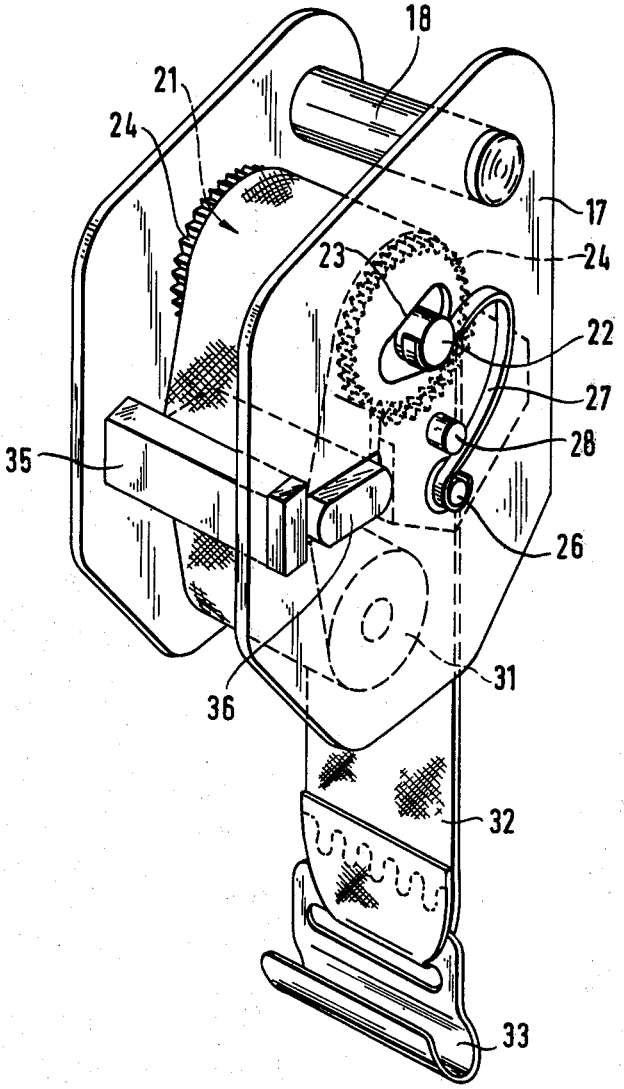
FIG. 6 is a perspective view of the embodiment according to FIGS. 3–5.

In FIGS. 3, 4 and 5, an embodiment according to the instant invention in the form of a device to brake free falling is shown. Hereby, a braking roller 21 is rotatably supported on a shaft 22 in a housing 17 which is suspended with a hook 20 by a pin 18 at a (load)-counter support 19. The support shaft 22 is essentially horizontally movable in slots 23 of the housing wall. At the side of the cylinder-like braking roller 21, locking teeth 24 are provided in the form of toothed discs. In the immediate vicinity of the braking roller 21, there is an arresting means 25 in the form of a two-armed rocker arm, which is by means of a rotatable shaft 26 hingeably supported at the opposite housing walls. A form-spring 27 is provided at the support shaft 26, which pushed the braking roller 21 into the rest position shown in FIG. 3, when the system is not activated. A pin-like swing stop 28 is fastened to the arresting means 25, and limits, in guide slots which are not shown, the swing-motion of the arresting means 25 at both sides. A circular arc-shaped locking-tooth portion 29 is formed at one arm of the arresting means 25, which acts together with the locking teeth 24 of the braking roller 21, while a pressure pad 30 is arranged at the other arm. Furthermore, a roller 31 for the pulling means 32 is rotatably supported at the housing 17, on which roller a certain amount of the pulling means 32 is wound-up. Starting from the roller 31, the pulling means 32 wraps half around the braking roller 21, and is provided at the other end with a load-hook 33. A pressure part 36 is arranged, so that it can move longitudinally between the pressure pad 30 of the arresting means 25, and a clamping surface 34 of a clamping bar 35. Now, if a pulling force acts at the hook 33 on the pulling means with a force strong enough to overcome the force of spring 27, the braking roller 21 is moved to the position shown in FIG. 4, wherein the locking teeth 24 and 29 are engaged with each other. By the force moment generated by the braking roller 21, due to the band-braking effect there, the arresting means 25 swing so that the clamping part 36 presses the pulling means 32 against the clamping surface 34 of the clamping bar with such force that the pulling means 32 is instantly blocked. With the removal of the pulling force, the braking roller 21 is again moved back to the original rest position by the force of the spring 27. The construction of the above-explained device can be learned from the perspective representation according to FIG. 6, especially the arrangement of the braking roller 21, spring 27, roller 31, pressure part 36 and clamping bar 35.

Figure 8:
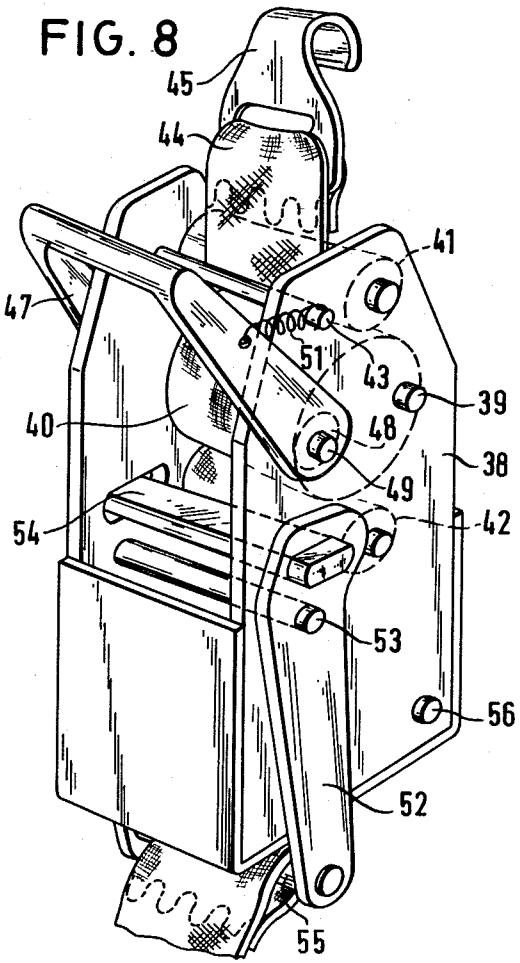
FIGS. 7 and 8 illustrate a third embodiment of the device according to the invention, in a perspective representation, and in a sectional view.
Figure 7:
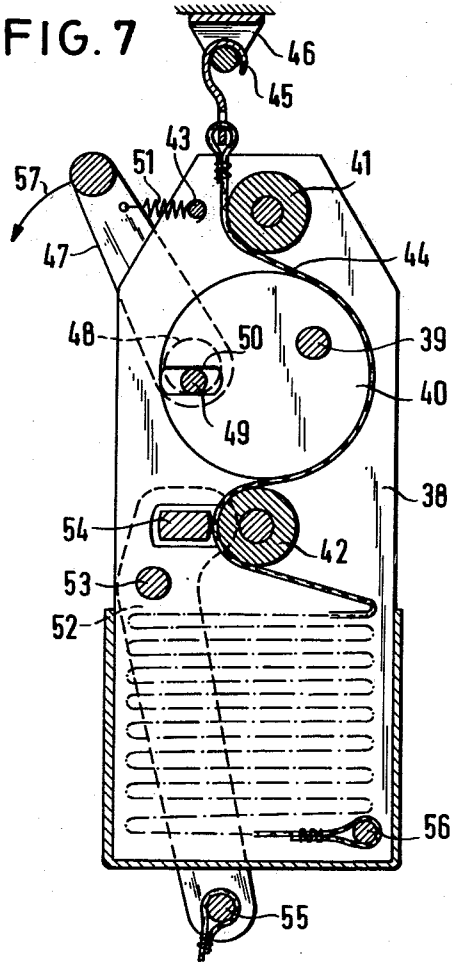

In the embodiment according to FIGS. 7 and 8, there is also provided an essentially U-shaped housing 38, wherein a braking roller 40 is hingeably supported on an eccentrical support shaft 39. A freely rotatable guide roller 41 is disposed in the housing 38 above the braking roller, while below the braking roller 40 there is a clamping roller 42 which is mounted in the housing 38, either rotatable or not rotatable. Adjacent to the guide roller 41, there is a guide pin 43 which prevents the pulling means 44, which is made also in form of a band-(belt), from entering too far into the device. The pull-out end of the pulling means 44 is provided with a hook 45, which is secured to an anchor point, respectively to a (load)counter support 46. The loose end of the pulling means is stored, stacked in a meander-like form, in the housing 38 below the clamping roller 42, as indicated by dotted lines. A hand lever 47 which is hingeably supported on a shaft 48, and is provided with at least one boss 49, which is eccentrically arranged to said shaft which is form-fittingly engaged in the grooves 50 of the braking roller 40, thereby coupling the hand lever 47 with the braking roller 40. The hand lever 47 is acted upon by the force of spring 51, which holds the hand lever in the position shown in FIGS. 7 and 8. A two-armed lever is hingeably supported in housing 38 on a shaft 53. A clamping bar 54 with a suitable clamp surface is arranged on the arm which is on top in the figures, while on the other arm an anchoring point 55 is provided for a load or a person. A pin 56 is secured to the housing 38, and the free end of the pulling means is fastened and secured to this pin. In the normal-or rest position, the hand lever 47 is pulled back by the spring 51 so far that the braking roller 40 is lightly pressed against the clamping roller 42 through the eccentric boss 49, and thus brakes the system when a load is applied. Thereby, the clamping forces between the parts 42 and 54, and also the band braking effect of the partly wrapped braking roller 40, are acting together. If the hand lever 47 is swung in the direction of the arrow 57, the braking roller 40 swings upward around the shaft 39, so that the pulling means 44 between the rollers 42 and 40 are released. If a load is applied to the anchor point 55, the braking bar 54 presses the pulling means 44 against the clamping roller 42 corresponding to the lever ratio of lever 52. By the suitable design of the wrap-around angle at the braking roller 40, a predetermined braking effect can be achieved at a certain pulling force, i.e. braking at a defined pull-out speed of the belt. Hereby, the hand lever 47 is raised. If one lets go of the hand lever 47, the latter is moved to its starting position by the force of spring 51, and the pulling means are instantly blocked. By this arrangement, the system adjusts itself automatically to any (weight) load, and the lowering speed remains constant, at a predetermined rate. This is an important safety feature, for example, for rope-down devices. For the lowering of loads, it is advantageous to exchange the anchor points 45 and 55, i.e. to fasten the load to hook 45. In the case of the device being used for lowering people, the person who is transported may adjust the constant lowering speed with the hand lever 47, to block the system instantly.

Figure 9:
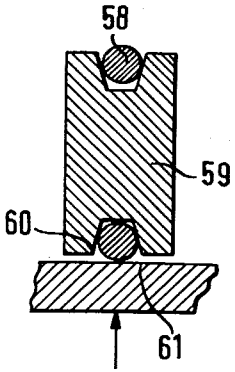
FIG. 9 is a configuration of the braking roller which varies from the preceding designs of the braking roller.

In FIG. 9, an embodiment is shown wherein a rope 58 is used as the pulling means. In this case, the braking roller 59 is not a straight cylinder, but is provided with a wedge-shaped center groove 60 in which the rope is guided with high-clamping friction, whereby a clamping surface 61 presses the rope 58 against the flanks of the wedge in the direction of the arrow for clamping.

In addition to the described applications of the device according to the invention, further applications of the device may be for quickly securing ropes or belts, for example, of towing machines, for attaching test straps in tensile strength test machines and the like.

In all described embodiments, it is advantageous to adjust the braking friction between the roll-surface of the braking roller which is to be stopped and the pulling means in such a way that a force moment is acting on the clamping surface, respectively on a transfer element between braking roller and the clamping surface, sufficient to clamp the pulling means without slippage. A mathematical calculation using the known laws of friction is given below relating to the embodiments according to FIGS. 1 and 2. In the example the pull-force or load$=S_2=$counter force $S_1 \times e^{\mu\alpha}$ whereby $\mu$ is the friction coefficient at the friction pair between roller surface and pulling means, and $\alpha$ the wraparound angle at the braking roller.

The friction force value is $\mu_1 \times N \geqq S_1$ whereby $\mu_1$ is the friction coefficient at the clamping point.

For the ratio of moments for $e^{\mu\alpha}7$, ($\alpha=180°$) the equation results as $$M=7\times a\times S_1-S_1\times b=S_1(7a-b)$$

and for the minimum clamping force $N=M/C=S_1/\mu_1$ and as the minimum friction value $\mu_1=c/7a-b$.

There are claimed:

1. Device for braking or blocking of load carrying flexible pulling means, such as belts or ropes, comprising a braking roller partly wrapped by the load carrying flexible pulling means and which can move with respect to a clamping surface when said pulling means exerts a tangential force on the braking roller, a non-rotating member with said clamping surface disposed adjacent the pulling means near the braking roller, said clamping surface providing the only contact surface between the non-rotating member and the pulling means, and braking roller movement effecting clamping of the pulling means against said clamping surface, wherein braking friction between the rolling surface of said braking roller when arrested and said pulling means is such that a force moment is acting between the braking roller and the clamping surface which is sufficient to clamp the pulling means without slippage.

2. Device for braking or blocking of load carrying flexible pulling means, such as belts or ropes, comprising a braking roller partly wrapped by the load carrying flexible pulling means and which can move with respect to a clamping surface when said pulling means exerts a tangential force on the braking roller, a member with said clamping surface disposed adjacent the pulling means near the braking roller, and braking roller movement effecting clamping of the pulling means against said clamping surface, wherein said braking roller, which is free-wheeling when not activated, moves against a moveable arresting element when activated by a predetermined pull-force, and wherein said arresting means is positioned to be moved toward said clamping surface which is stationary to effect clamping of a portion of the pulling means adjacent said clamping surface, and wherein the arresting means has means attached thereto to urge the arresting means to an unclamped position.

3. Device for braking or blocking of load carrying flexible pulling means, such as belts or ropes, comprising a braking roller partly wrapped by the load carrying flexible pulling means and which can move with respect to a clamping surface when said pulling means exerts a tangential force on the braking roller, a member with said clamping surface disposed adjacent the pulling means near the braking roller, and braking roller movement effecting clamping of the pulling means against said clamping surface, wherein said braking roller, which is free-wheeling when not activated, moves against a moveable arresting element when activated by a predetermined pull-force, and wherein said arresting means is positioned to be moved toward said clamping surface which is stationary to effect clamping of a portion of the pulling means adjacent said clamping surface, and wherein the arresting means has means attached thereto to urge the arresting means to an unclamped position and, wherein said braking roller and said arresting means each have teeth, with the teeth of the braking roller engaging the teeth of the arresting means upon movement of the braking roller and contact with the arresting means.

4. Device for braking or blocking according to claim 2, wherein said arresting means is constructed as two-armed rocker arm which can rotate around a stationary axle, and is provided at one arm with locking teeth, and at the other arm with a pressure pad.

5. Device for braking or blocking of load carrying flexible pulling means, such as belts or ropes, comprising a braking roller partly wrapped by the load carrying flexible pulling means and which can move with respect to a clamping surface when said pulling means exerts a tangential force on the braking roller, a member with said clamping surface disposed adjacent the pulling means near the braking roller, and braking roller movement effecting clamping of the pulling means against said clamping surface and, wherein said braking roller is rotatably mounted on a shaft in a housing so that it can swing in the housing, eccentrically and in relation to said clamping surface through a path determined by a swing-stop disposed in the path in said housing up to its contact with said clamping surface.

6. Device for braking or blocking of load carrying flexible pulling means, such as belts or ropes, comprising a braking roller partly wrapped by the load carrying flexible pulling means and which can move with respect to a clamping surface when said pulling means exerts a tangential force on the braking roller, a member with said clamping surface disposed adjacent the pulling means near the braking roller, and braking roller movement effecting clamping of the pulling means against said clamping surface and, wherein said braking roller is rotatably mounted on a shaft in a housing so that it can swing in the housing, eccentrically and in relation to said clamping surface through a path determined by a swing-stop disposed in the path in said housing up to its contact with said clamping surface, wherein said braking roller is pressed by the force of a spring against said clamping surface, and wherein said swing stop is connected with the braking roller and extends from the housing, and wherein said swing stop is provided with a handle, by which the roller clamped against the surface can be lifted from the clamping surface.

7. Device for braking or blocking according to claim 5, wherein the load carrying portion of pulling means exits at the housing side opposite to the clamping surface, and wherein a pulling means portion which has a pull-handle is provided before the clamping surface, and wherein the housing is secured to a counter support for the load.

8. Device for braking or blocking of load carrying flexible pulling means, such as belts or ropes, comprising a braking roller partly wrapped by the load carrying flexible pulling means and which can move with respect to a clamping surface when said pulling means exerts a tangential force on the braking roller, a member with said clamping surface disposed adjacent the pulling means near the braking roller, and braking roller movement effecting clamping of the pulling means against said clamping surface and, wherein the braking roller is eccentrically supported in a housing, and is pressed against a clamping roller by the force of a spring, and wherein the pulling means, which is fastened to a load counter support, partly wraps around the braking-and clamping roller, and wherein a two-armed lever, which is hingeably supported at the housing, carries at one arm the load, and at the other lever arm a clamping pad, which can press against the pulling means and the clamping roller by the force moment generated by the load.

9. Device for braking or blocking according to claim 8, wherein a hand lever which is hingeably supported at the housing is form-fittingly and eccentrically coupled to the braking roller, and presses the braking roller against the clamping roller by said spring force, and wherein the braking roller can be raised from the clamping roller by moving the hand lever against the spring force.

10. Device for braking or blocking according to claim 9, wherein said pulling means has its loose end stored in the housing.

* * * * *